United States Patent [19]

Closson

[11] Patent Number: 4,541,179

[45] Date of Patent: Sep. 17, 1985

[54] SIGHTING DEVICE FOR USE ON BOWS

[76] Inventor: Robert A. Closson, Rte. #1 - Box 50A, Townsend, Mont. 59644

[21] Appl. No.: 603,313

[22] Filed: Apr. 24, 1984

[51] Int. Cl.[4] ..... F41G 1/00

[52] U.S. Cl. ..... 33/265; 124/87

[58] Field of Search ..... 33/265; 124/24 R, 24 A, 124/25, 87

[56] References Cited

U.S. PATENT DOCUMENTS

| | | | |
|---|---|---|---|
| 2,642,661 | 6/1953 | Fredrickson | 124/24 R |
| 3,013,336 | 12/1961 | Pennington | 33/265 |
| 3,318,298 | 5/1967 | Bear | 33/265 |
| 3,487,548 | 1/1970 | Frydenlund | 33/265 |

FOREIGN PATENT DOCUMENTS

| | | | |
|---|---|---|---|
| 1914783 | 3/1969 | Fed. Rep. of Germany | 33/265 |

*Primary Examiner*—Charles Frankfort
*Assistant Examiner*—Patrick R. Scanlon
*Attorney, Agent, or Firm*—A. W. Breiner; A. W. Breiner

[57] ABSTRACT

A sighting device for a bow which is fixedly mounted on a bow and which is provided with a lever and link arrangements such that a sight unit thereof is tilted at a progressively increasing rate as the sighting device is adjusted for longer distances so as to compensate for gravity effect on arrows. Also, the sight unit is so mounted whereby it tilts relative to the bow in a manner wherein the sight unit generally lies in a plane which is normal to the sighting axis therethrough for all adjustments of the sighting device.

12 Claims, 4 Drawing Figures

SIGHTING DEVICE FOR USE ON BOWS

This invention relates in general to new and useful improvements in sighting devices, and more particularly to a sighting device for use on bows.

The invention particularly relates to a sighting device which is adjustable to compensate for various distances from a target and which includes a sight unit that is pivotally mounted whereby when the sighting device is adjusted, the sight unit will move progressively and incrementally a greater amount to compensate for the effect of gravity on an arrow.

Another feature of the invention is the provision of a sighting device for use on bows wherein there is a sight unit fixedly mounted on a carrier plate and wherein the sight unit tilts as the sighting device is adjusted for distances whereby the sight unit remains in a plane normal to the line of sight therethrough for all different distance settings.

Another feature of the invention is the provision of a sighting device which includes a support which may be fixedly mounted on a bow and which support carries a lever which in turn pivotally mounts a carrier plate and wherein there is a link which extends between and is pivotally connected to both the support and carrier plate so as to tilt the plate relative to the lever as the sighting device is adjusted.

A further feature of the invention is a sight unit which includes a ring having mounted therein in crossing relation horizontal and vertical cross-hairs and there being associated with the cross-hairs a ball-type sighting element which is in close relation with these cross-hairs and is aligned therewith. The ball-type sight element is carried by an upstanding tapered post.

Other objects and advantages reside in the details of construction and operation as will more fully hereinafter be described and claimed, reference being had to the accompanying drawing forming a part hereof, wherein like numerals refer to like parts throughout, and in which:

Figures 1, 2, 3, 4:
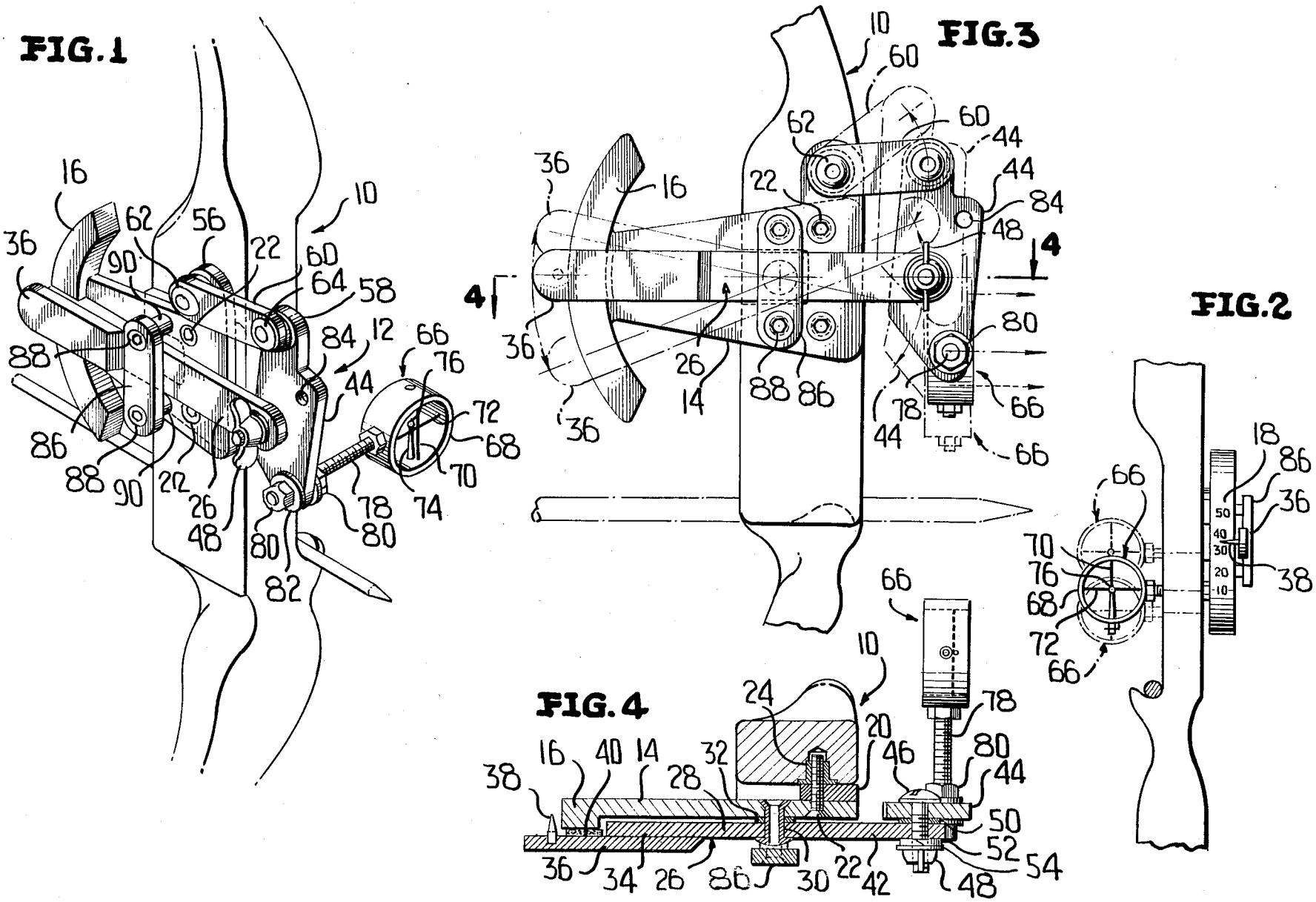
FIG. 1 is a front prospective view of the sighting device attached to a bow.
FIG. 2 is a rear elevational view of the sighting device and shows the manner in which the sight unit thereof adjusts vertically as the sighting device is adjusted.
FIG. 3 is a side elevational view of the sighting device of FIG. 1 and shows in phantom lines several positions of the sighting device.
FIG. 4 is a horizontal sectional view taken generally along the line 4—4 of FIG. 3, and shows the relationship of the various components of the sighting device.

Referring now to the drawings, it will be seen that there is illustrated a conventional bow, generally identified by the numeral 10, on which there is mounted a sighting device in accordance with this invention, the sighting device being generally identified by the numeral 12. The sighting device 12 includes a support 14 which is elongated and which tapers rearwardly, as is shown in FIG. 3. The support 14 carries at the rear end thereof an arcuate element 16 which is provided on the rear surface thereof with a gauge 18 (FIG. 2) which indicates the distance to a target.

Preferably, the support 14 is fixedly mounted on the bow 10 in slightly spaced relation by means of a spacer 20 and by means of suitable fasteners 22 which may be threaded into nut members 24 mounted within the bow

10 as is best shown in FIG. 4. As will be apparent, however, the sighting device can be mounted using other mounting means. For example, some bows are equipped with a mounting plate which has a dove-tailed slotted opening therein. The present sighting device can be fitted with a mating dove-tailed mounting member. This will permit rapid mounting and de-mounting of the sighting device simply by slipping the sighting device into the mated mounting plate.

An elongated lever 26 has an intermediate portion 28 thereof pivotally mounted on the support 14 in spaced parallel relation by means of a hollow rivet 30. The lever 26 is spaced from the support 14 by means of a washer or spacer 32.

The lever 26 has a rear portion 34 which carries in offset relation an extension 36 which extends rearwardly beyond the archery members 16 and carries a pointer 38 which is aligned with the gauge 18, as is best shown in FIGS. 2 and 4. It will be apparent, however, that lever 26 need not have the offset extension 36, but rather can be a continuous straight member. With such modification, member 16 will not be as thick, permitting the lever 26 to move along member 16 as before. This modification can have an advantage from the economic standpoint. A felt pad 40, FIG. 4, is carried by the extension 36 for engagement with the side face of the archery member 16.

The lever 26 also includes a forward portion 42 on which there is mounted a central portion of a carrier plate 44 by way of a bolt-type fastener 46. The fastener 46 extends through the carrier plate 44 and the forward portion of the lever 26 and is provided with a quick-adjusting wing nut 48.

The fastener 46 carries between the carrier plate 44 and the lever 26 a spacer or washer 50. The fastener 46 also carries between the lever 26 and the wing nut 48 a lock washer 52 and a flat washer 54.

As is best shown in FIGS. 1 and 3, the forward part of the support 14 is provided at the upper corner thereof with an upstanding ear 56. A similar ear 58 extends upwardly from the upper rear corner of the carrier plate 44. A link 60 extends between the ears 56 and 58, and is pivotally connected thereto by means of pivot members 62, 64 in the form of tubular rivets. As will be apparent, however, tubular rivets 62 and 64 can be replaced with fastening means similar to fastening means 46, including a wing nut and washer such as 48, which permits removal and replacement.

The carrier plate 44 carries a sight unit generally identified by the numeral 66. The sight unit 66 includes a ring member 68 which has mounted in a forward portion thereof vertical and horizontal intersecting cross-hairs 70, 72. The sight unit 66 also includes an upstanding tapered post 74 carried by the ring 68 in alignment with the vertical cross-hairs 70. The post 74 terminates at its upper end in a ball-type sight element 76 which is centered on the intersecting cross-hairs 70, 72, as is best shown in FIG. 2.

The ring 68 is carried by its threaded rod 78 which has one end thereof fixed to the ring 68, and which has the opposite end thereof threaded into a bore through a lower forward portion of the carrier plate 48. The sight unit 66 is locked in an adjusted angular position as well as the adjusted transfer position relative to the carrier plate 44 by means of locking nuts 80 and associated washers 82.

The carrier plate 44 is also provided in the upper forward portion thereof with a second internally threaded bore 84 through which the threaded rod 78 may extend if it is desired to mount the sight unit 66 in a higher position.

The support 14 also carries a quiver plate 86 which overlies the rivet 30 (FIG. 4) and is secured to the support 14 in spaced relation relative thereto by means of threaded fasteners 88 which pass through spacers 90.

It is to be understood that the wing nut 48 will be loosened when it is desired to adjust the sight unit 66, and the lever 26 will be moved up or down depending upon the required adjustment. When the sight unit 66 is adjusted, the wing nut 48 is again tightened down.

It is also to be understood that the relationship of the lever 26, the link 60, and the connections between the lever 26 and the link 60 with the support 14 and the carrier plate 44 will be one wherein for a uniform movement of the pointer 38 relative to the gauge 18 and an increased target distance direction there will be a progressive increase in movement of the sight unit to compensate for the effect of gravity on an arrow. Further, it will be seen that the link 60 effects a tilting of the carrier plate 44 relative to the lever 26 such that the sight unit 66 is tilted relative to the bow so that the sight unit 66 always lies in a plane normal to the line of sight through the sight unit to a target.

It is preferred that the various components of the sighting device will be dark in color, normally black, so as to prevent light reflection.

Although only a preferred embodiment of the sighting device has been specifically illustrated and described herein, it is to be understood that minor variations may be made in the sighting device without departing from the spirit or scope of the invention as defined by the appended claims.

It is claimed:

1. An adjustable sight for an archery bow, said sight comprising a support having means for fixedly mounting on a bow, said support having front and rear ends, an arcuate gauge on said support at said rear end, a lever having an intermediate position pivotally mounted on said support, said lever having front and rear ends, said lever rear end carrying a pointer cooperating with said arcuate gauge, a carrier plate pivotally mounted on said lever at said lever front end, a sight unit fixedly carried by said carrier plate, and a link extending between said carrier plate and said support front end and pivotally connected thereto, the relationship of said lever, said link and the connections between said lever and said link with said support and said carrier plate being one whereby for a uniform movement of said pointer along said gauge towards an increased target distance position there is a progressive increase in movement of said sight unit to compensate for the increase in effect of gravity.

2. A sight according to claim 1 wherein the length of said link is materially less than the effective length of said lever between the pivotal connections of said lever to said support and said carrier plate.

3. A sight according to claim 2 wherein said lever forms the primary support for said carrier plate and said link forms means for tilting said sight as said sight moves with said lever wherein said sight generally remains in a plane normal to a line of sight by an archer to an intended target.

4. A sight according to claim 1 wherein said lever forms the primary support for said carrier plate and said link forms means for tilting said sight as said sight moves with said lever wherein said sight generally remains in a plane normal to a line of sight by an archer to an intended target.

5. A sight according to claim 4 wherein said carrier plate is vertically elongated, the pivotal connection between said lever and said carrier plate being generally mid-height of said carrier plate, said link is connected to a top portion of said carrier plate, and said sight is carried by a lower portion of said carrier plate, and said link forming means for effecting tilting of said carrier plate relative to said lever.

6. A sight according to claim 5 wherein there are means for locking one of said pivotal connections to lock said sight in an adjusted position.

7. A sight according to claim 4 wherein the length of said lever between said intermediate portion and said lever rear end is greater than the length of said lever between said intermediate portion and said lever front end.

8. A sight according to claim 4 wherein said support and said carrier plate have adjacent upstanding ears, and said link extends between said ears.

9. A sight according to claim 1 wherein said sight unit is on a side of said carrier plate remote from said lever and said link.

10. A sight according to claim 1 wherein a quiver plate is carried by said support in spaced overlying relation to said lever intermediate position.

11. A sight according to claim 1 wherein said sight unit includes a ring, intersecting vertical and horizontal cross-hairs within said ring, and a ball-type sight element within said ring behind said cross-hairs and in alignment with said intersection of said cross-hairs.

12. A sight according to claim 11 wherein said ball-type sight element is carried by an upstanding tapered post.

* * * * *